US008193688B2

(12) United States Patent
Chin

(10) Patent No.: US 8,193,688 B2
(45) Date of Patent: Jun. 5, 2012

(54) LED LAMP HAVING HIGHER EFFICIENCY

(76) Inventor: Wen-Lung Chin, Taipei Hsien (TW)

( * ) Notice: Subject to any disclaimer, the term of this patent is extended or adjusted under 35 U.S.C. 154(b) by 158 days.

(21) Appl. No.: 12/648,537

(22) Filed: Dec. 29, 2009

(65) Prior Publication Data

US 2011/0156565 A1 Jun. 30, 2011

(51) Int. Cl.
*H01J 61/52* (2006.01)
*H01J 1/62* (2006.01)
*H01J 63/04* (2006.01)

(52) U.S. Cl. ..... 313/46; 313/483; 313/567; 313/11

(58) Field of Classification Search ..... None
See application file for complete search history.

(56) References Cited

U.S. PATENT DOCUMENTS

2006/0098440 A1* 5/2006 Allen ..... 362/294
2007/0230188 A1* 10/2007 Lin ..... 362/294

FOREIGN PATENT DOCUMENTS

EP 2105659 A1 * 9/2009

* cited by examiner

*Primary Examiner* — Natalie Walford
(74) *Attorney, Agent, or Firm* — Alan Kamrath; Kamrath IP Lawfirm, PA

(57) ABSTRACT

An LED lamp includes a heatsink housing (2) and an alternating current LED module (1). The alternating current LED module includes a heat conducting portion (10) combined with the heatsink housing and two electrical connections (11) electrically connected with an external power supply. Thus, the heatsink housing forms a porous structure to provide a greater heatsink effect and to quickly carry away the heat produced by the alternating current LED module to enhance the heat dissipation efficiency of the alternating current LED module. In addition, the heatsink housing is directly formed to have the profile of a common lamp housing and is provided with a metallic screw base (21), an insulating gasket (22) and a power contact plate (23) so that the heatsink housing can be mounted on a traditional receptacle to replace the conventional electric bulb.

6 Claims, 16 Drawing Sheets

LED LAMP HAVING HIGHER EFFICIENCY

BACKGROUND OF THE INVENTION

1. Field of the Invention

The present invention relates to a lamp and, more particularly, to an LED (light emitting diode) lamp to provide a lighting function.

2. Description of the Related Art

A conventional LED (light emitting diode) lamp comprises an LED to emit light outwardly so as to provide a lighting function. However, the LED is a heat source and easily produces a high temperature during operation, so that it is necessary to provide a heat sink to carry away the heat produced by the LED to prevent the LED from being inoperative due to an overheat. A conventional heat sink generally comprises a heatsink element, such as a metallic heatsink fin, a heat conductive tube, a chill enabling chip, a heat dissipation board, a cooling fan and the like, so as to provide a heat dissipation effect to the LED. However, the conventional heat sink cannot dissipate the heat from the heat source exactly and quickly, thereby greatly decreasing the heat dissipation efficiency. In addition, the conventional heat sink has a very complicated construction, thereby increasing the costs of fabrication. Further, the conventional heat sink does not have an electrically insulating feature, thereby causing danger during operation. Further, the conventional heat sink is not a standardized product so that it cannot be mounted on a traditional lamp.

BRIEF SUMMARY OF THE INVENTION

In accordance with one embodiment of the present invention, there is provided an LED (light emitting diode) lamp, comprising a heatsink housing and an alternating current LED module mounted in the heatsink housing. The alternating current LED module includes a heat conducting portion and two electrical connections. The heat conducting portion of the alternating current LED module is combined with the heatsink housing. The electrical connections of the alternating current LED module are electrically connected with an external power supply. The heatsink housing forms a nonmetallic porous structure with a great heat dissipation feature. The heatsink housing is formed to have the profile of a common lamp housing. The heatsink housing has a hollow inside provided with a receiving chamber to receive the alternating current LED module.

In accordance with another embodiment of the present invention, there is provided an LED (light emitting diode) lamp, comprising a heatsink housing, at least one alternating current LED module mounted in the heatsink housing, and a heat conducting member mounted on the heatsink housing. The alternating current LED module includes a heat conducting portion and two electrical connections. The heat conducting portion of the alternating current LED module is combined with the heat conducting member. The electrical connections of the alternating current LED module are electrically connected with an external power supply. The heatsink housing forms a nonmetallic porous structure with a great heat dissipation feature. The heatsink housing is formed to have the profile of a common lamp housing.

The primary objective of the present invention is to provide an LED lamp having a higher efficiency.

Another objective of the present invention is to provide an LED lamp having a greater heatsink effect.

A further objective of the present invention is to provide an LED lamp, wherein the heatsink housing forms a porous structure with a great heat dissipation feature and a high specific surface area to provide a greater heatsink effect and to quickly carry away the heat produced by the alternating current LED module so as to enhance the heat dissipation efficiency of the alternating current LED module.

A further objective of the present invention is to provide an LED lamp, wherein the heatsink housing is directly formed to have the profile of a common lamp housing and is provided with a metallic screw base, an insulating gasket and a power contact plate so that the heatsink housing can be mounted on a traditional receptacle to replace the conventional electric bulb.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
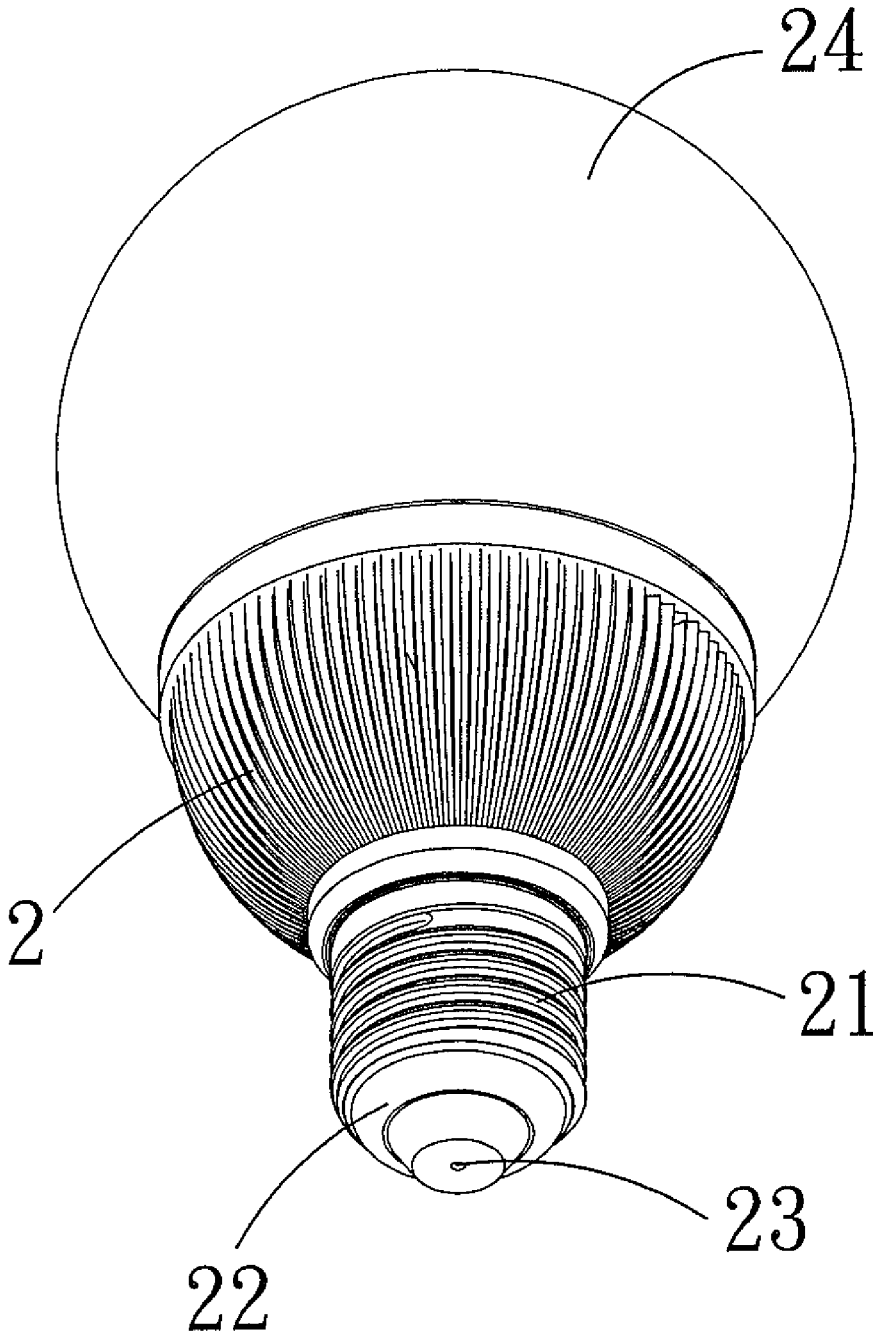
FIG. 1 is a perspective view of an LED lamp in accordance with the preferred embodiment of the present invention.
Figure 2:
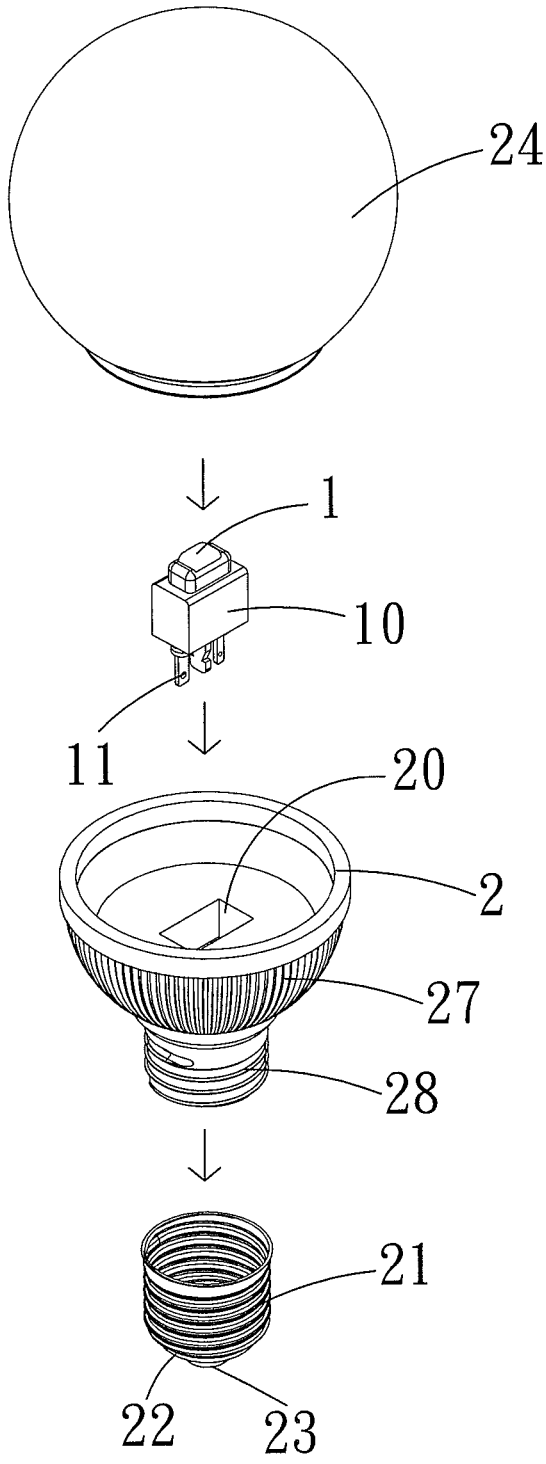
FIG. 2 is an exploded perspective view of the LED lamp as shown in FIG. 1.
Figure 3:
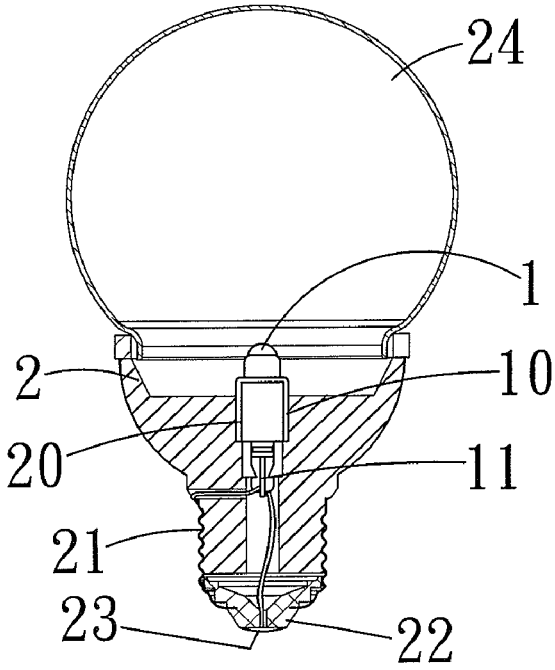
FIG. 3 is a front cross-sectional view of the LED lamp as shown in FIG. 1.

Referring to the drawings and initially to FIGS. 1-3, an LED (light emitting diode) lamp in accordance with the preferred embodiment of the present invention comprises a heatsink housing 2, an alternating current LED module 1 mounted in the heatsink housing 2, and a shade 24 mounted on the heatsink housing 2 to encompass the alternating current LED module 1.

The alternating current LED module 1 is a modularized product. The alternating current LED module 1 includes a heat conducting portion 10 and two electrical connections 11. The heat conducting portion 10 of the alternating current LED module 1 is combined with the heatsink housing 2. The electrical connections 11 of the alternating current LED module 1 are electrically connected with an external power supply (not shown) to electrically connect the alternating current LED module 1 to the external power supply.

The heatsink housing 2 forms a porous structure with a great heat dissipation feature and a high specific surface area. The porous structure formed by the heatsink housing 2 is made of a nonmetallic powder (formed by an injection molding process) having a great heat conductivity, such as $Al_2O_3$, $Zr_2O$, AlN, SiN, BN, WC, C, SiC, crystalline SiC, Recrystalline SiC(ReSiC) and the like. Preferably, the nonmetallic powder making the porous structure is AlN and SiC. The heatsink housing 2 has a hollow inside provided with a receiving chamber 20 to receive the alternating current LED module 1. Preferably, the heat conducting portion 10 of the alternating current LED module 1 is received in the receiving chamber 20 of the heatsink housing 2. The heatsink housing 2 is formed to have the profile of a common lamp housing (or socket). Preferably, the heatsink housing 2 has a substantially semi-spherical profile. The heatsink housing 2 has an end portion provided with a threaded stud 28 for mounting a metallic screw base 21, an insulating gasket 22 and a power contact plate 23. Preferably, each of the metallic screw base 21, the insulating gasket 22 and the power contact plate 23 has an international specification of E-27, E-14 and the like. The metallic screw base 21 and the power contact plate 23 are electrically connected to the electrical connections 11 of the alternating current LED module 1. The heatsink housing 2 has a surface provided with a plurality of heatsink grooves 27 to increase a heatsink surface area of the heatsink housing 2 so as to enhance the heat dissipation efficiency of the heatsink housing 2. The heatsink housing 2 has an electrically insulating feature.

In operation, when the alternating current LED module 1 is operated, the heat produced by the alternating current LED module 1 is transferred by the heat conduction of the heatsink housing 2, so that the heat produced by the alternating current LED module 1 is carried away exactly and quickly so as to enhance the heat dissipation efficiency of the alternating current LED module 1.

In such a manner, the heatsink housing 2 forms a porous structure with a great heat dissipation feature and a high specific surface area to provide a greater heatsink effect and to quickly carry away the heat produced by the alternating current LED module 1 so as to enhance the heat dissipation efficiency of the alternating current LED module 1. In addition, the heatsink housing 2 is directly formed to have the profile of a common lamp housing and is provided with a metallic screw base 21, an insulating gasket 22 and a power contact plate 23 so that the heatsink housing 2 can be mounted on a traditional receptacle to replace the conventional electric bulb.

Figure 5:
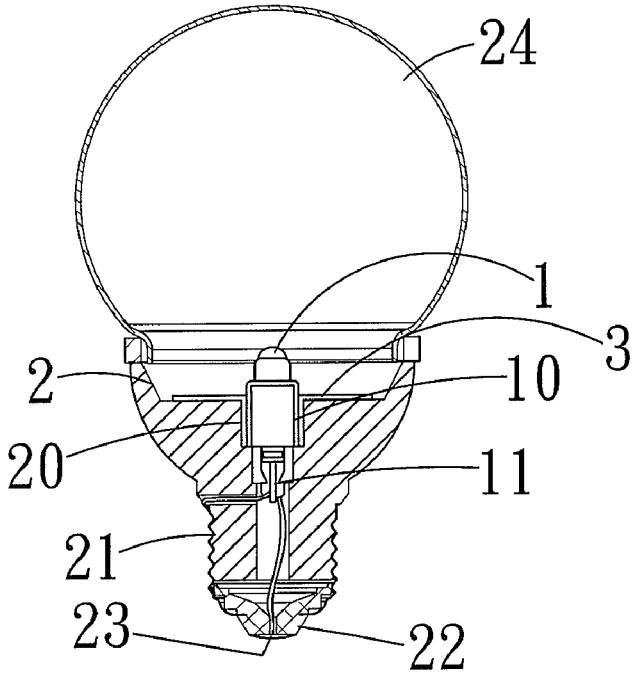
FIG. 5 is a front cross-sectional assembly view of the LED lamp as shown in FIG. 4.
Figure 4:
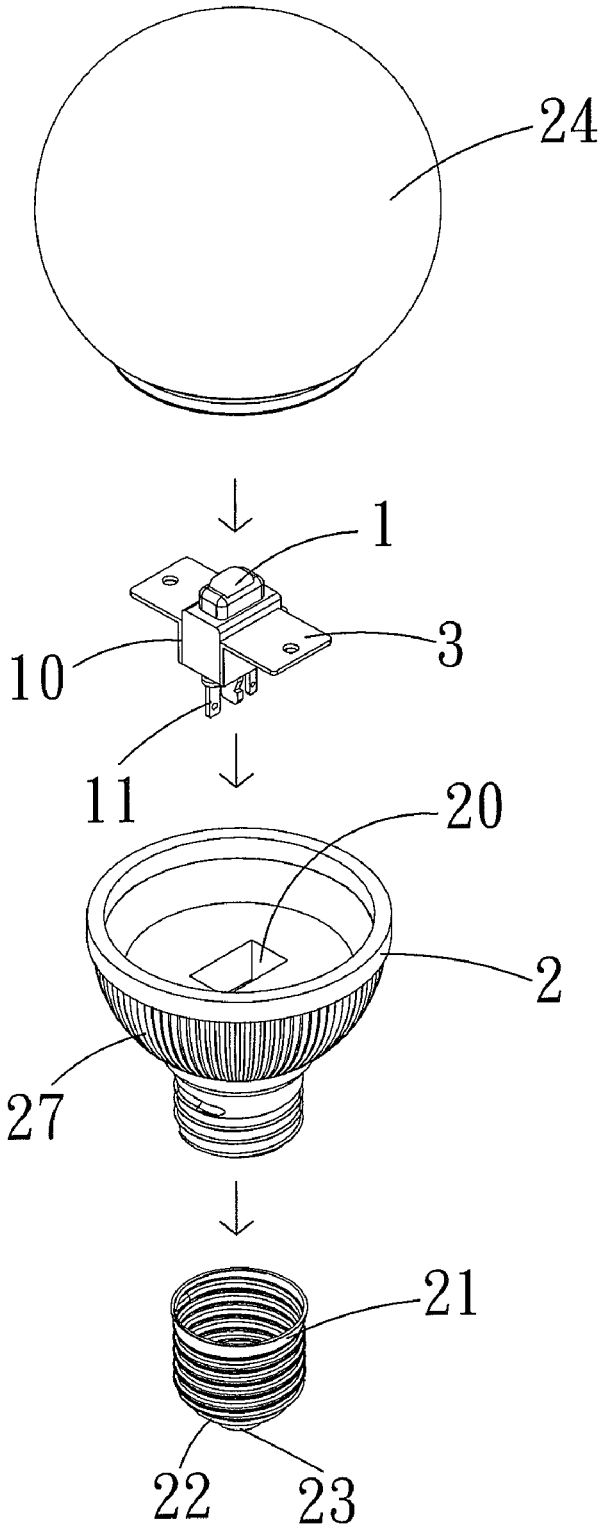
FIG. 4 is an exploded perspective view of an LED lamp in accordance with another preferred embodiment of the present invention.

Referring to FIGS. 4 and 5, the LED lamp further comprises a heat conducting plate 3 mounted between the heat conducting portion 10 of the alternating current LED module 1 and the heatsink housing 2 to carry away the heat produced by the alternating current LED module 1 so as to enhance the heat dissipation efficiency of the alternating current LED module 1. The heat conducting plate 3 is made of a metal having a great heat conductivity, such as gold, silver, copper, iron, aluminum, cobalt, nickel, zinc, titanium, manganese and the like.

In operation, when the alternating current LED module 1 is operated, the heat produced by the alternating current LED module 1 is transferred by the heat conduction and the heat convection between the heat conducting plate 3 and the heatsink housing 2, so that the heat produced by the alternating current LED module 1 is carried away exactly and quickly so as to enhance the heat dissipation efficiency of the alternating current LED module 1.

In such a manner, the heatsink housing 2 co-operates with the heat conducting plate 3 to provide a greater heatsink effect and to quickly carry away the heat produced by the alternating current LED module 1 so as to enhance the heat dissipation efficiency of the alternating current LED module 1.

Figure 6:
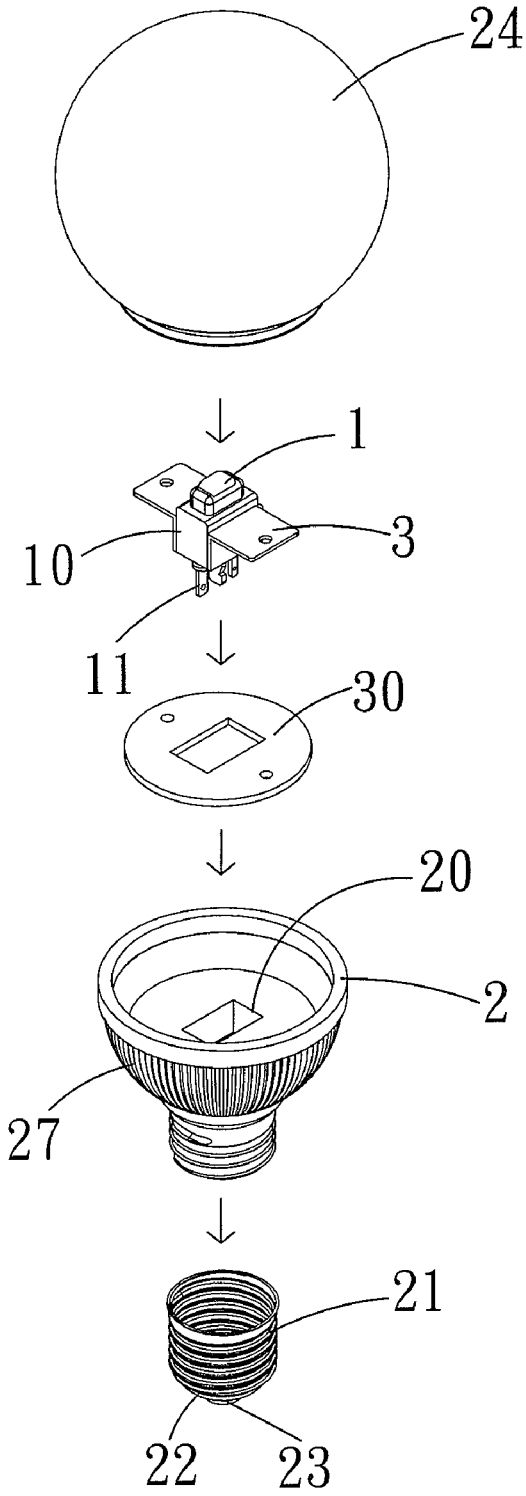
FIG. 6 is an exploded perspective view of an LED lamp in accordance with another preferred embodiment of the present invention.
Figure 7:
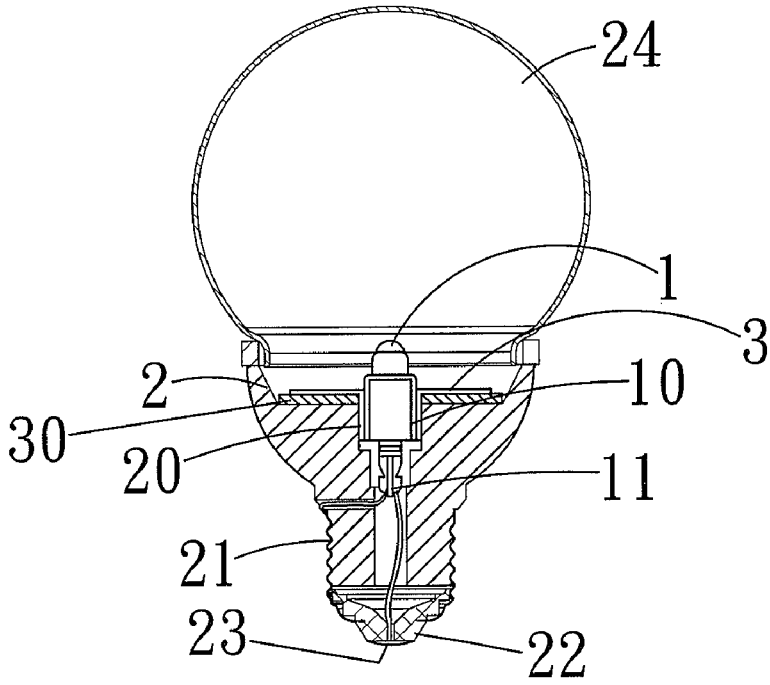
FIG. 7 is a front cross-sectional assembly view of the LED lamp as shown in FIG. 6.
Figure 8:
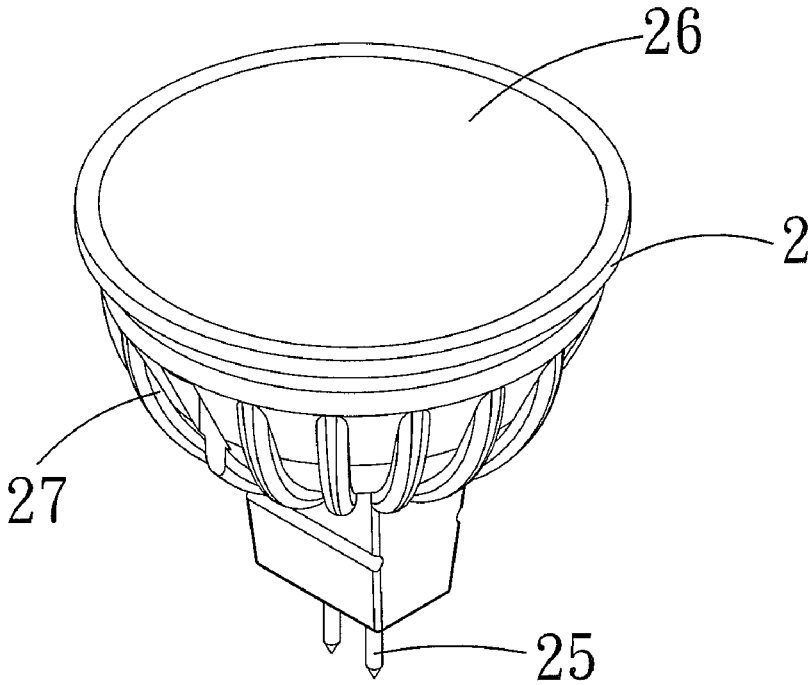
FIG. 8 is a perspective view of an LED lamp in accordance with another preferred embodiment of the present invention.
Figure 9:
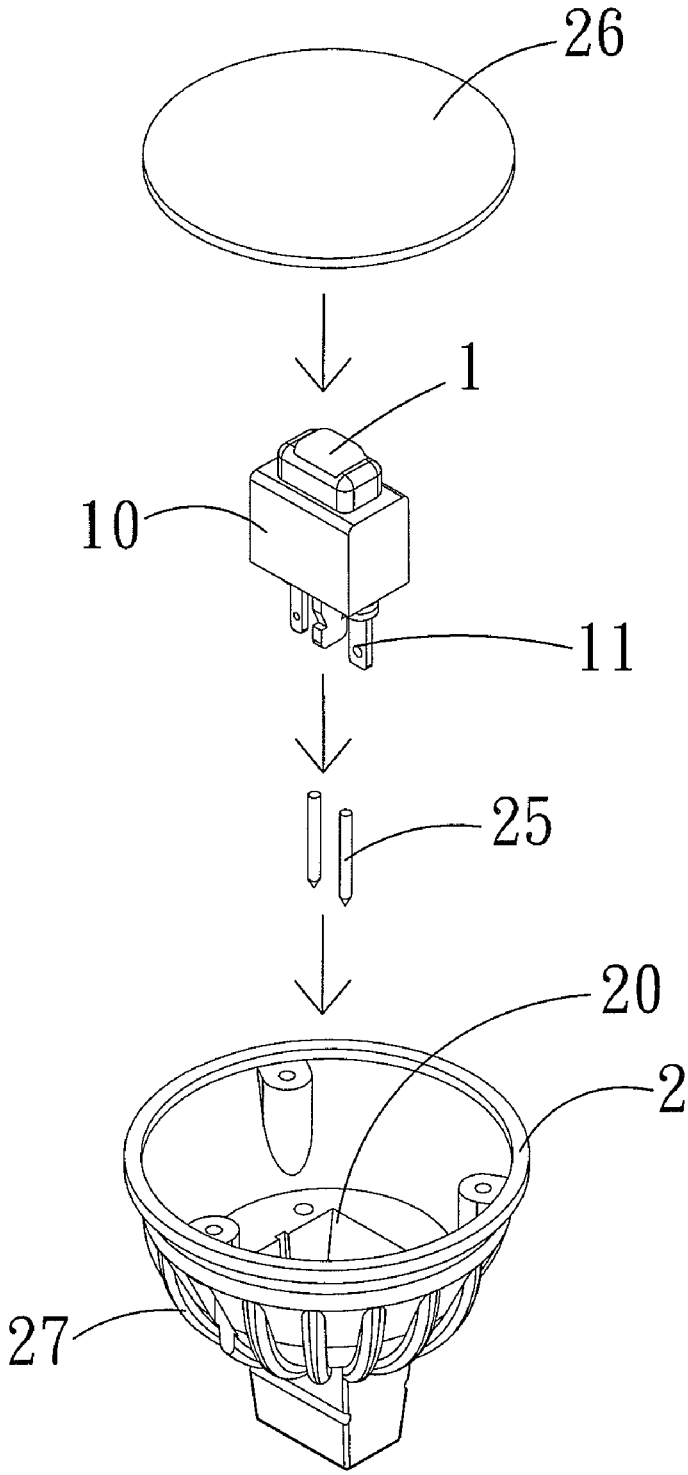
FIG. 9 is an exploded perspective view of the LED lamp as shown in FIG. 8.
Figure 10:
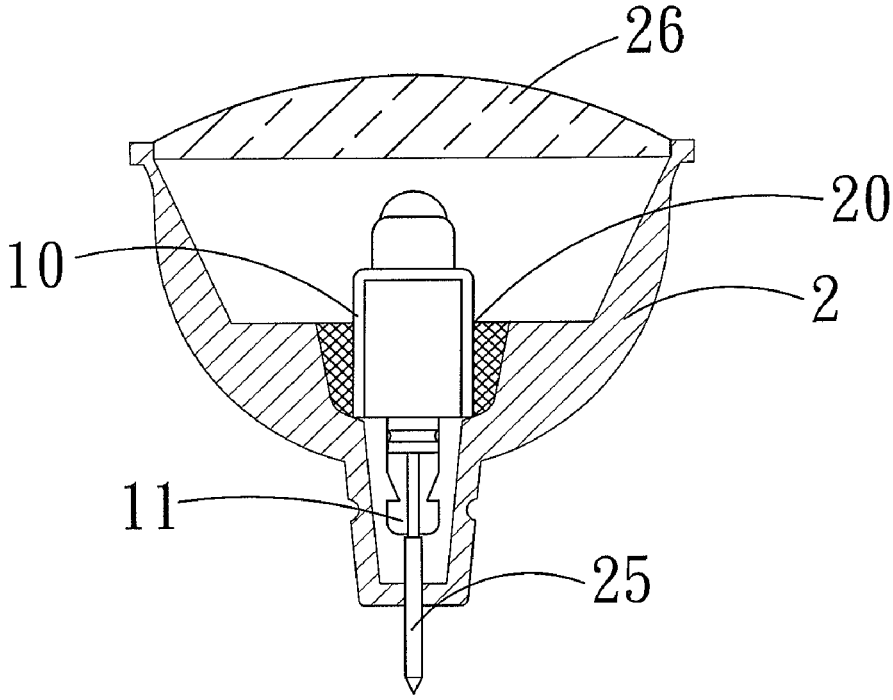
FIG. 10 is a front cross-sectional view of the LED lamp as shown in FIG. 8.
Figure 12:
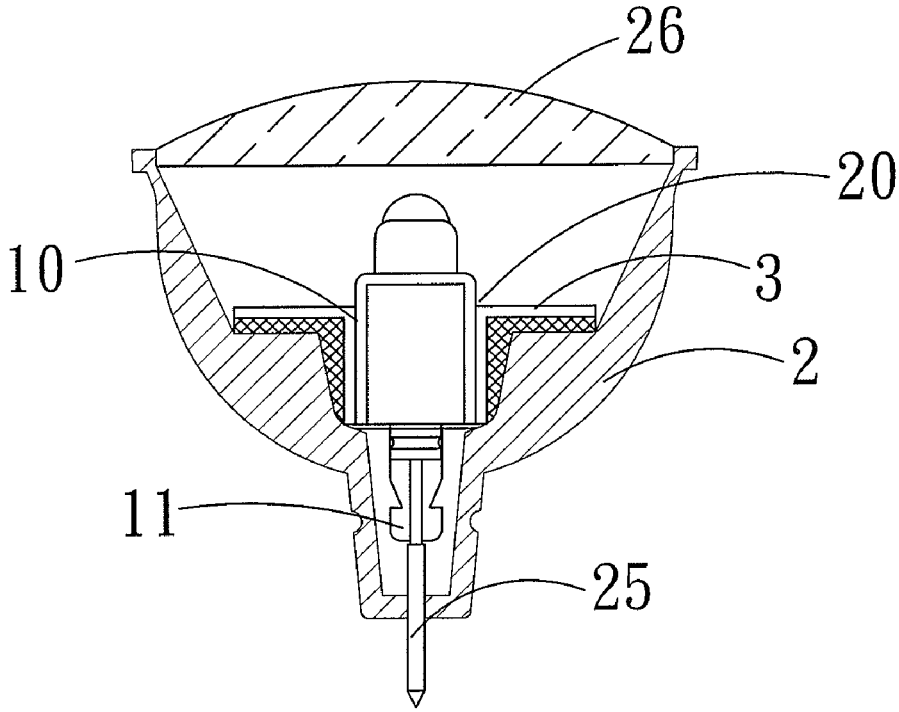
FIG. 12 is a front cross-sectional assembly view of the LED lamp as shown in FIG. 11.
Figure 11:
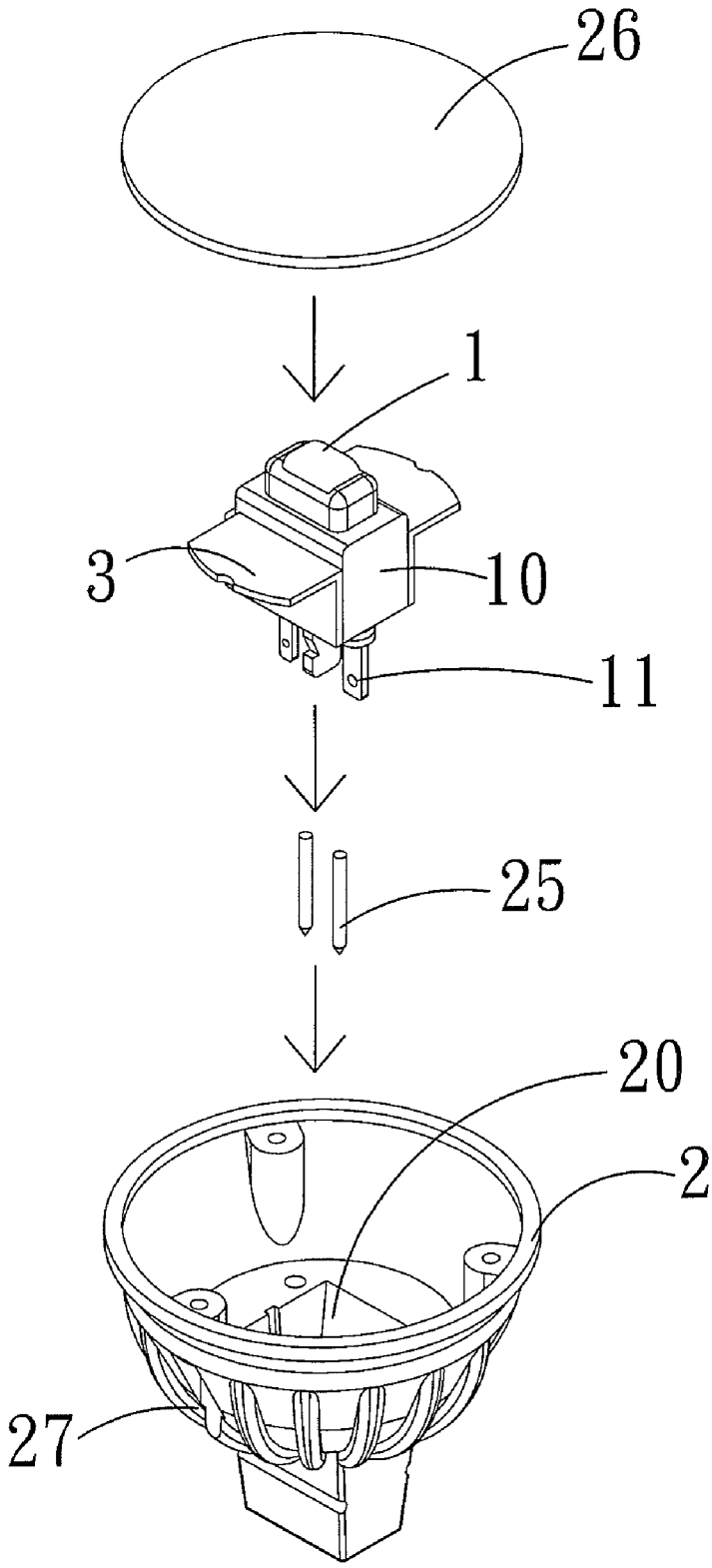
FIG. 11 is an exploded perspective view of an LED lamp in accordance with another preferred embodiment of the present invention.

Referring to FIGS. 6 and 7, the LED lamp further comprises a conduction board 30 mounted between the heat conducting plate 3 and the heatsink housing 2 to carry away the heat produced by the alternating current LED module 1 so as to enhance the heat dissipation efficiency of the alternating current LED module 1. The conduction board 30 is made of a metal having a great heat conductivity, such as gold, silver, copper, iron, aluminum, cobalt, nickel, zinc, titanium, manganese and the like.

In such a manner, the heat of the heat conducting plate 3 is transmitted through the conduction board 30 to the heatsink housing 2 quickly so as to enhance the heat dissipation efficiency of the alternating current LED module 1.

Referring to FIGS. 8-12, the LED lamp further comprises two connecting pins 25 (with an international specification of MR16 and the like) electrically connected with the electrical connections 11 of the alternating current LED module 1 and protruding outwardly from the heatsink housing 2 to electrically connect the alternating current LED module 1 to an external power supply (not shown). The LED lamp further comprises a reflective shade 26 mounted on the heatsink housing 2 to encompass the alternating current LED module 1. Thus, the LED lamp functions as a projection lamp to replace the traditional projection lamp.

Figure 13:
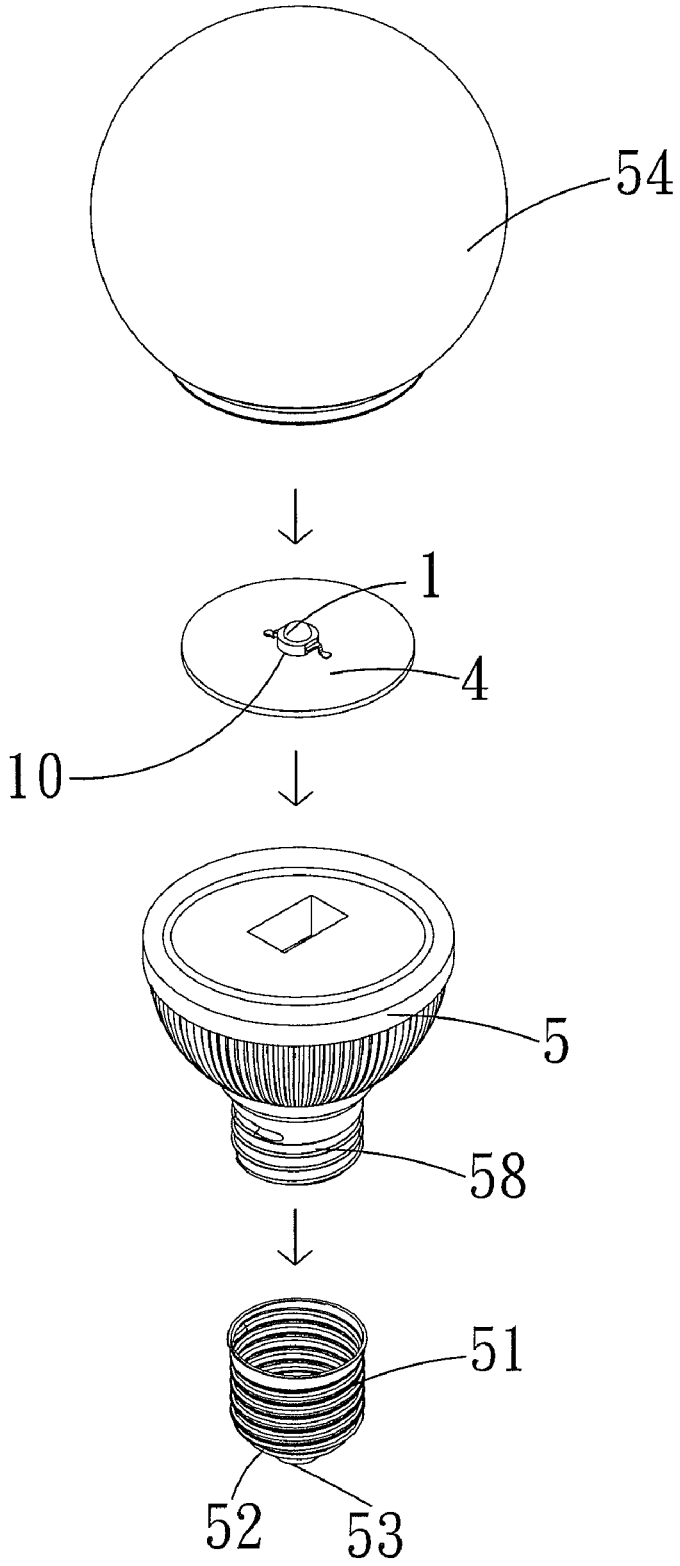
FIG. 13 is an exploded perspective view of an LED lamp in accordance with another preferred embodiment of the present invention.
Figure 14:
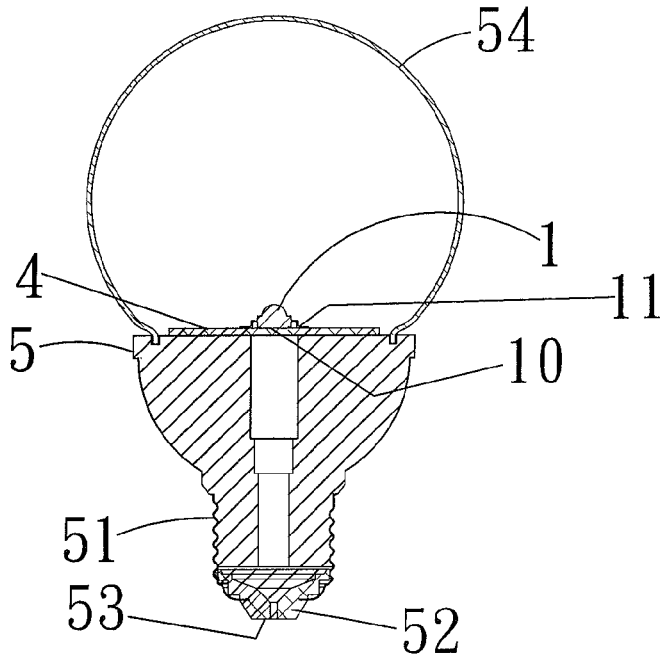
FIG. 14 is a front cross-sectional assembly view of the LED lamp as shown in FIG. 13.

Referring to FIGS. 13 and 14, an LED (light emitting diode) lamp in accordance with another preferred embodiment of the present invention comprises a heatsink housing 5, at least one alternating current LED module 1 mounted in the heatsink housing 5, a heat conducting member 4 mounted on the heatsink housing 5 and a shade 54 mounted on the heatsink housing 5 to encompass the alternating current LED module 1 and the heat conducting member 4.

The alternating current LED module 1 includes a heat conducting portion 10 and two electrical connections 11. The heat conducting portion 10 of the alternating current LED module 1 is combined with the heat conducting member 4. The electrical connections 11 of the alternating current LED module 1 are electrically connected with an external power supply (not shown) to electrically connect the alternating current LED module 1 to the external power supply.

The heatsink housing 5 forms a porous structure with a great heat dissipation feature and a high specific surface area. The porous structure formed by the heatsink housing 5 is made of a nonmetallic powder (formed by an injection molding process) having a great heat conductivity, such as $Al_2O_3$, $Zr_2O$, AlN, SiN, BN, WC, C, SiC, crystalline SiC, Recrystalline SiC(ReSiC) and the like. Preferably, the nonmetallic powder making the porous structure is AlN and SiC. The heatsink housing 5 is formed to have the profile of a common lamp housing (or socket). Preferably, the heatsink housing 5 has a substantially semi-spherical profile. The heatsink housing 5 has an end portion provided with a threaded stud 58 for mounting a metallic screw base 51, an insulating gasket 52 and a power contact plate 53. Preferably, each of the metallic screw base 51, the insulating gasket 52 and the power contact plate 53 has an international specification of E-27, E-14 and the like. The metallic screw base 51 and the power contact plate 53 are electrically connected to the electrical connections 11 of the alternating current LED module 1.

The heat conducting member 4 is preferably made of a metal having a great heat conductivity, such as gold, silver, copper, iron, aluminum, cobalt, nickel, zinc, titanium, manganese and the like. Alternatively, the heat conducting member 4 is preferably made of a nonmetallic material having a great heat conductivity, such as $Al_2O_3$, $Zr_2O$, AlN, SiN, BN, WC, C, SiC, crystalline SiC, Recrystalline SiC(ReSiC) and the like. Preferably, the nonmetallic powder making the porous structure is AlN and SiC.

In operation, when the alternating current LED module 1 is operated, the heat produced by the alternating current LED module 1 is transferred by the heat conduction and the heat convection between the heat conducting member 4 and the heatsink housing 5, so that the heat produced by the alternating current LED module 1 is carried away exactly and quickly so as to enhance the heat dissipation efficiency of the alternating current LED module 1.

As shown FIG. 13, the alternating current LED module 1 is combined with the heat conducting member 4 after assembly.

Figure 15:
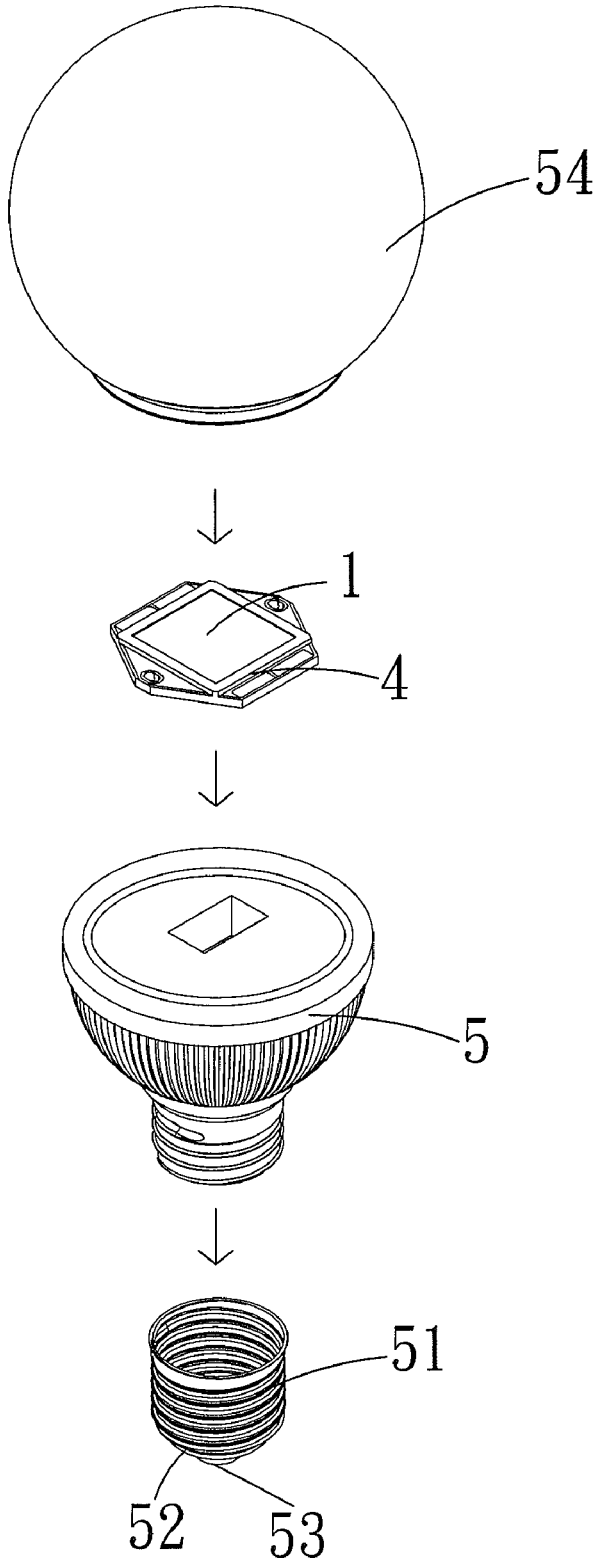
FIG. 15 is an exploded perspective view of an LED lamp in accordance with another preferred embodiment of the present invention.

As shown FIG. 15, the heat conducting member 4 is directly integrally formed with the alternating current LED module 1.

Figure 16:
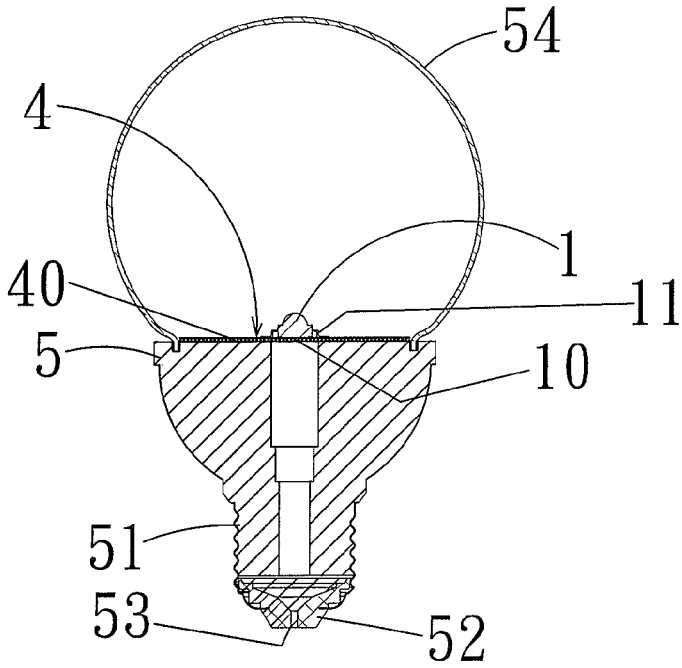
FIG. 16 is a front cross-sectional view of an LED lamp in accordance with another preferred embodiment of the present invention.

As shown FIG. 16, the heat conducting member 4 is directly integrally formed on the heatsink housing 5 to form a metallic heat conducting layer 40 on the heatsink housing 5.

Figure 17:
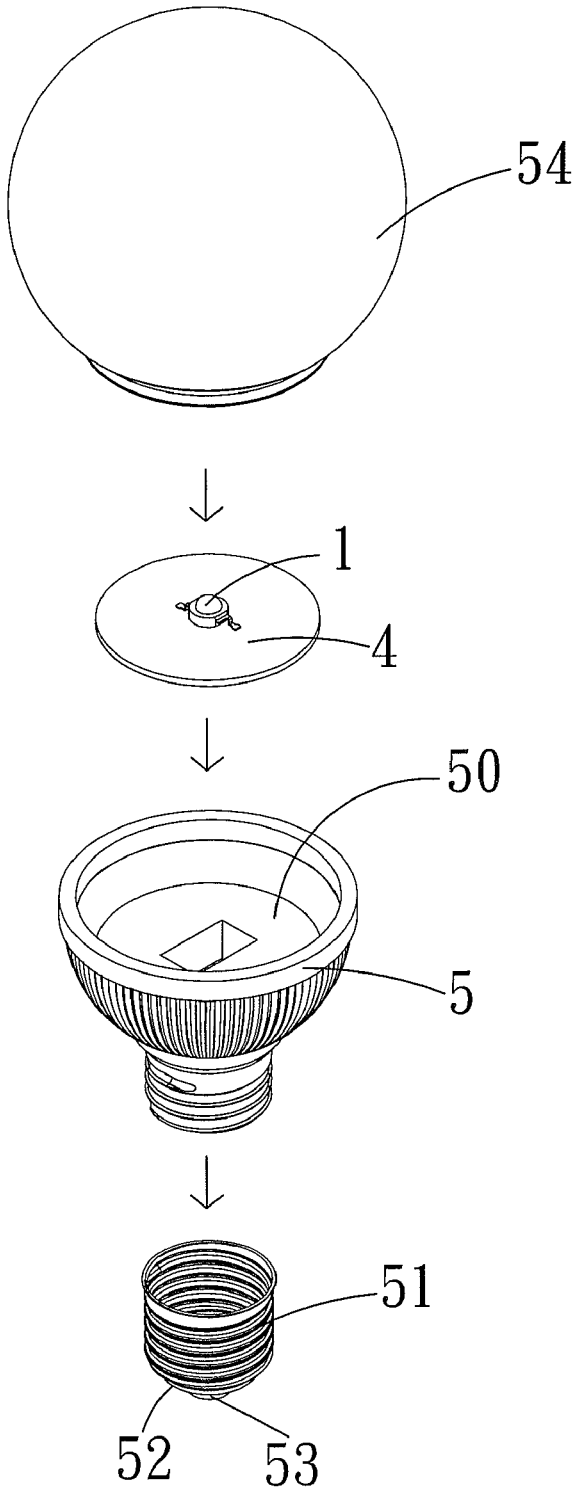
FIG. 17 is an exploded perspective view of an LED lamp in accordance with another preferred embodiment of the present invention.
Figure 18:
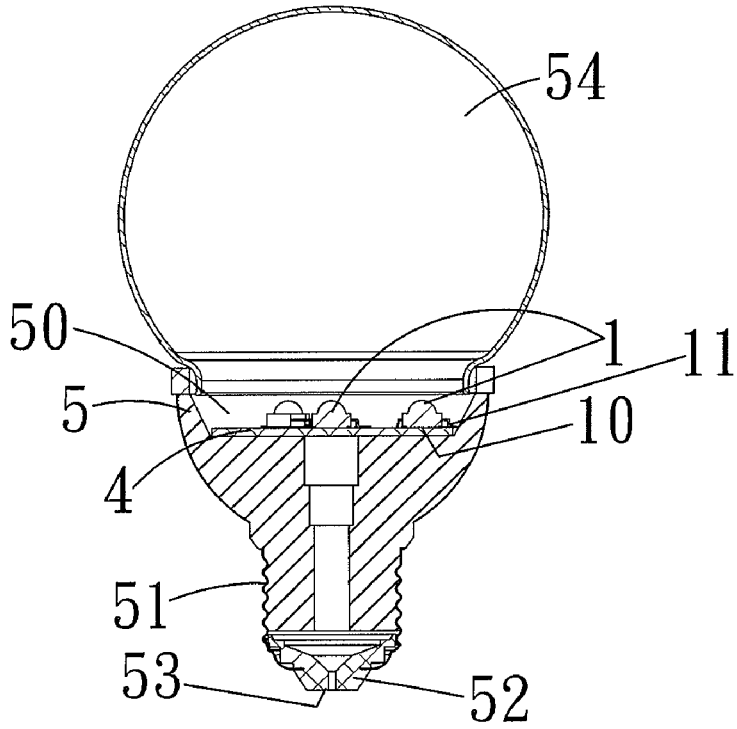
FIG. 18 is a front cross-sectional assembly view of the LED lamp as shown in FIG. 17.

Referring to FIGS. 17 and 18, the heatsink housing 5 has a hollow inside provided with a receiving chamber 50 to receive the alternating current LED module 1 and the heat conducting member 4.

Figure 19:
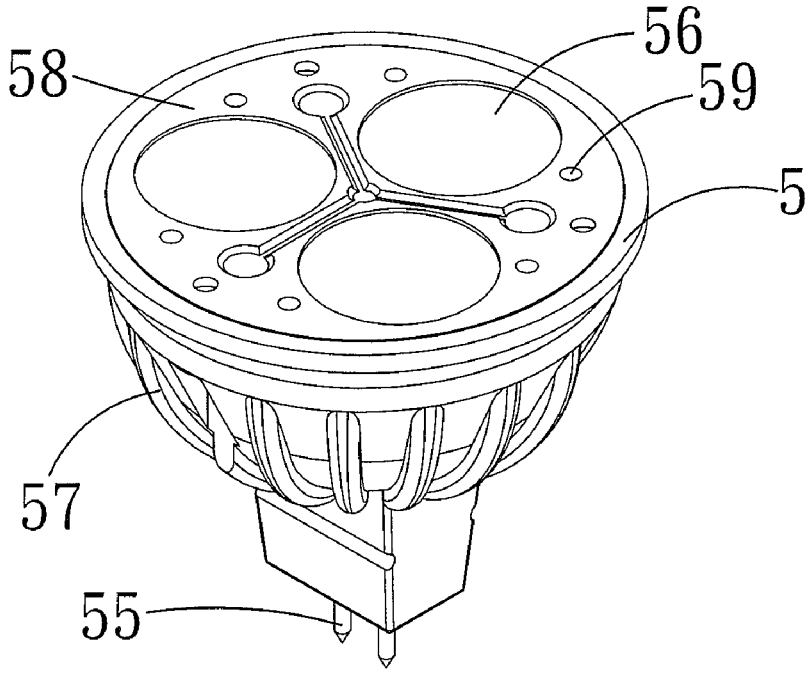
FIG. 19 is a perspective view of an LED lamp in accordance with another preferred embodiment of the present invention.
Figure 20:
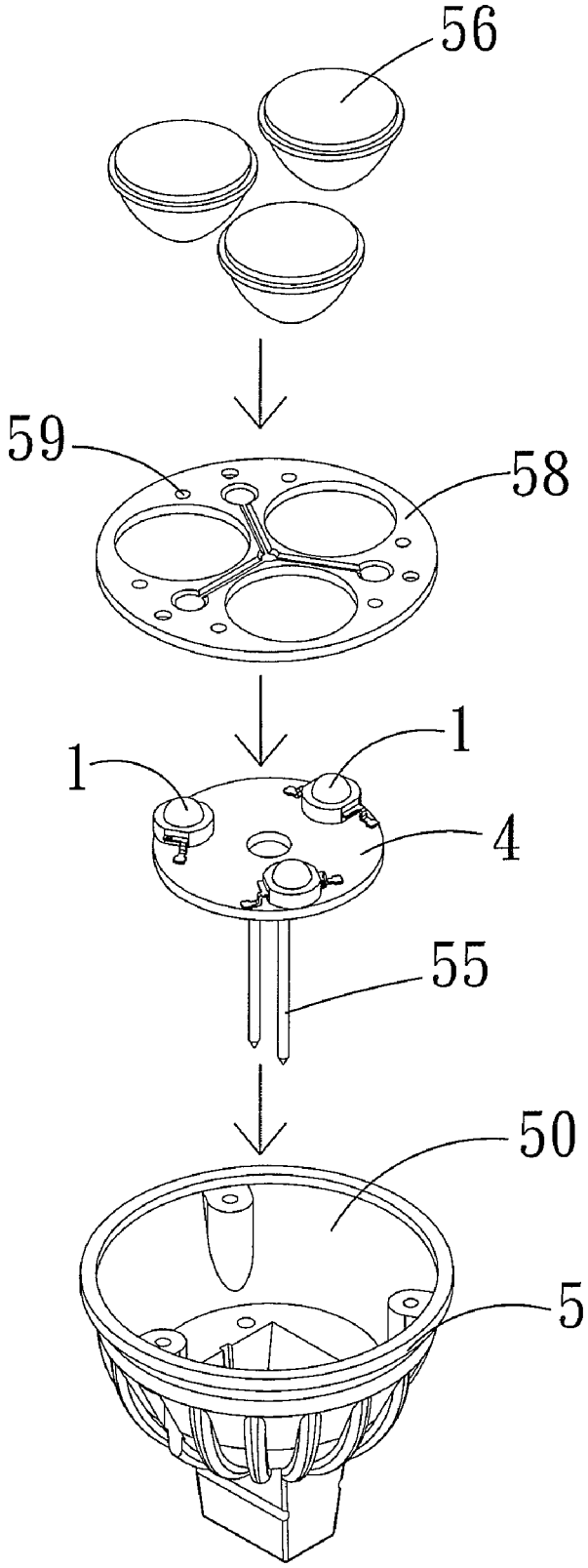
FIG. 20 is an exploded perspective view of the LED lamp as shown in FIG. 19.
Figure 21:
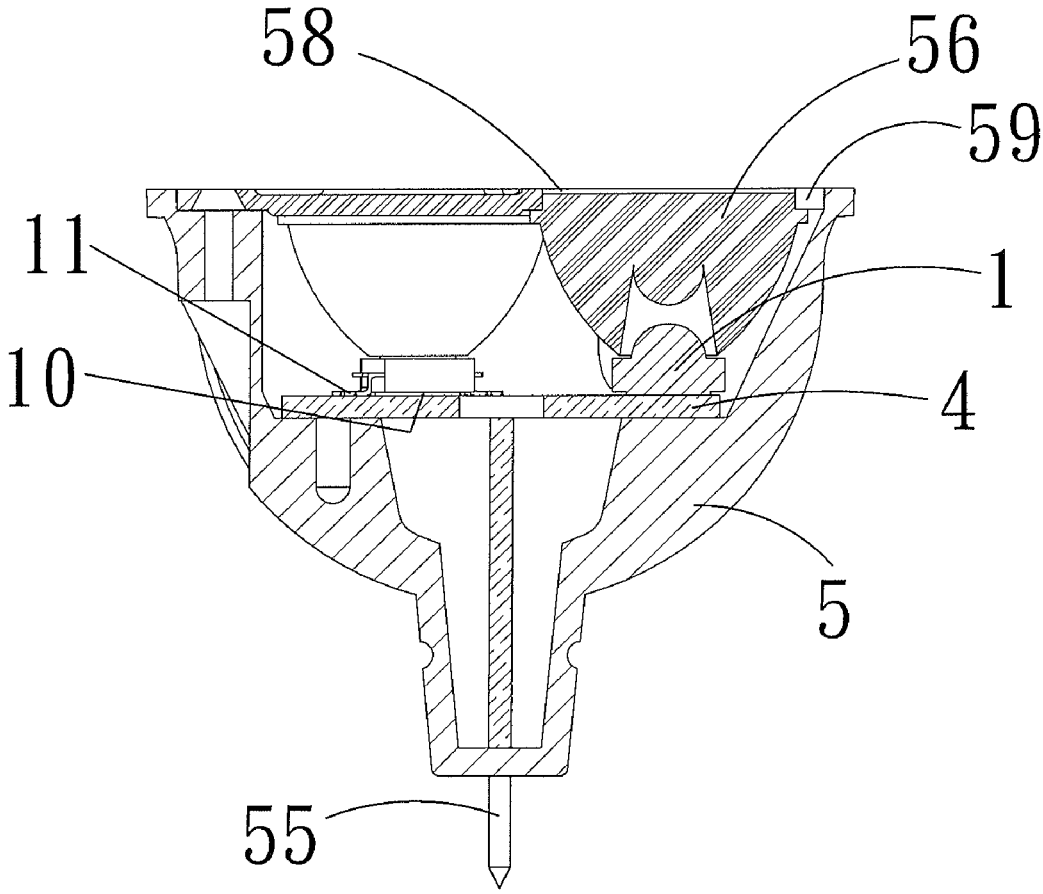
FIG. 21 is a front cross-sectional view of the LED lamp as shown in FIG. 19.

Referring to FIGS. 19-21, the LED lamp further comprises two connecting pins 55 (with an international specification of MR16 and the like) electrically connected with the electrical connections 11 of the alternating current LED module 1 and protruding outwardly from the heatsink housing 5 to electrically connect the alternating current LED module 1 to an external power supply (not shown). The LED lamp further comprises a mounting board 58 mounted on the heatsink housing 5, and at least one reflective shade 56 mounted on the mounting board 58 to encompass the at least one alternating current LED module 1. Thus, the LED lamp functions as a projection lamp to replace the traditional projection lamp. The mounting board 58 has a plurality of ventilating holes 59 connected to the receiving chamber 50 the heatsink housing 5 to provide a heat convection effect so as to enhance the heat dissipation efficiency of the alternating current LED module 1. The heatsink housing 5 has a surface provided with a plurality of heatsink grooves 57 to increase a heatsink surface area of the heatsink housing 5 so as to enhance the heat dissipation efficiency of the heatsink housing 5.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An LED (light emitting diode) lamp, comprising:

a heatsink housing (2);

an alternating current LED module (1) mounted in the heatsink housing;

wherein the alternating current LED module includes a heat conducting portion (10) and two electrical connections (11);

the heat conducting portion of the alternating current LED module is combined with the heatsink housing;

the electrical connections of the alternating current LED module are electrically connected with an external power supply;

the heatsink housing forms a nonmetallic porous structure with a great heat dissipation feature;

the heatsink housing is formed to have the profile of a common lamp housing;

the heatsink housing has a hollow inside provided with a receiving chamber (20) to receive the alternating current LED module;

the LED lamp further comprises:

a heat conducting plate (3) mounted between the heat conducting portion of the alternating current LED module and the heatsink housing;

a conduction board (30) mounted between the heat conducting plate and the heatsink housing;

the heat conducting plate is made of a metal having a great heat conductivity;

the heat conducting portion of the alternating current LED module is encompassed by the heat conducting plate;

the heat conducting plate separates the heat conducting portion of the alternating current LED module from the heatsink housing;

the conduction board is made of a metal having a great heat conductivity;

the conduction board has a top face abutting the heat conducting plate and a bottom face abutting the heatsink housing.

2. The LED lamp in accordance with claim 1, wherein the heat conducting portion of the alternating current LED module is partially received in and partially protruded outward from the receiving chamber of the heatsink housing;

the electrical connections of the alternating current LED module are fully received and hidden in the receiving chamber of the heatsink housing;

the heat conducting plate is partially received in and partially protruded outward from the receiving chamber of the heatsink housing;

the conduction board is fully protruded outward from the receiving chamber of the heatsink housing;

the heatsink housing has an end portion provided with a threaded stud (28) for mounting a metallic screw base (21), an insulating gasket (22) and a power contact plate (23);

the metallic screw base and the power contact plate are electrically connected to the electrical connections of the alternating current LED module.

3. The LED lamp in accordance with claim 2, further comprising:

a shade (24) mounted on the heatsink housing to encompass the alternating current LED module.

4. The LED lamp in accordance with claim 1, further comprising:

two connecting pins (25) electrically connected with the electrical connections of the alternating current LED module, wherein the two connecting pins are partially received in and partially protruding outwardly from the heatsink housing.

5. The LED lamp in accordance with claim 4, further comprising:

a reflective shade (26) mounted on the heatsink housing to encompass the alternating current LED module.

6. The LED lamp in accordance with claim 1, wherein the heatsink housing has a surface provided with a plurality of heatsink grooves (27) to increase a heatsink surface area of the heatsink housing.

* * * * *